United States Patent [19]

Penney

[11] 4,212,399

[45] Jul. 15, 1980

[54] SHOE MOUNTING APPARATUS

[76] Inventor: William H. Penney, 15 Putnam St., Revere, Mass. 02151

[21] Appl. No.: 968,549

[22] Filed: Dec. 11, 1978

[51] Int. Cl.[2] ..... A47F 7/08

[52] U.S. Cl. ..... 211/35; 248/310

[58] Field of Search ..... 211/35, 34, 37, 38, 211/87, 89; 248/310, 316 A, 313, 298, 287

[56] References Cited

U.S. PATENT DOCUMENTS

| | | | |
|---|---|---|---|
| 2,150,802 | 3/1939 | Latch | 211/89 |
| 2,277,253 | 3/1942 | Pollinger | 211/37 |
| 2,448,227 | 8/1948 | McCan | 248/117.1 |
| 2,519,244 | 8/1950 | Goldsberry | 211/35 |
| 2,541,434 | 2/1951 | Nelson et al. | 248/313 X |
| 2,620,072 | 12/1952 | Searcy | 211/35 |
| 2,695,105 | 11/1954 | Mitchell | 211/35 |
| 2,783,367 | 2/1957 | Locke | 248/287 X |
| 3,730,469 | 5/1973 | Shields | 248/287 X |

*Primary Examiner*—Roy D. Frazier
*Assistant Examiner*—Robert W. Gibson, Jr.
*Attorney, Agent, or Firm*—Robert D. Farkas

[57] ABSTRACT

A shoe mounting apparatus utilizes two elongated straps, each having a hook-like end, disposed at one end thereof, and another hook-like end, whose axis is askew to the longitudinal axis of the strap. Mounting holes are provided, through each strap, for mounting the pair of straps to a vertical standard, thereby enabling a pair of shoes to be placed within the apparatus, having the sole and heel portions thereof engaging the vertical standard and being retained within the straps by engaging opposite sides of the sole edge, intermediate the instep and the toe portion of each shoe. In one embodiment, each strap is bifurcated and provided with slots, thereby permitting the apparatus to be adjusted as to the distance separating the hook-like ends, accommodating thereby, shoes of various widths.

9 Claims, 4 Drawing Figures

SHOE MOUNTING APPARATUS

BACKGROUND OF THE INVENTION

1. The Field of the Invention

This invention relates to shoe mounting apparatuses, and more particularly to that class of device which engages the exterior perimeter of the sole portion of the shoe, supporting the shoe on a vertical standard thereby.

2. Description of the Prior Art

The prior art abounds with shoe mounting devices. U.S. Pat. No. 1,326,749, issued Dec. 30, 1919 to J. J. Leckey discloses a slipper holder utilizing a strap, having a pair of openings formed by bending the strap into spectacle shaped cross sections. Each of the openings accommodate a shoe or slipper therein, whilst the common portion of the strap is provided with openings for mounting the apparatus to a vertical standard. The Leckey apparatus lacks the ability to mount shoes of a wide range of sole thicknesses therein, including the disadvantage of grasping the vamp portion of the shoe, thereby increasing the possibilities of scuffing the exterior surface of the vamp.

U.S. Pat. No. 2,695,105, issued Nov. 23, 1954, to J. P. Mitchell discloses a shoe holding bracket utilizing an elongated bar having a track extending along the length thereof. The track provides a plurality of slidable members which may be secured at preferred locations. Attached to each of the slidable members is a shoe clamping bracket, biased away from the slidable bracket to which it is affixed, utilizing a spring therefor. The shoe mounting brackets are of two general varieties, one having a shoe clamping surface askew from the longitudinal axis of the track, whilst the other variety is provided with a shoe mounting bracket extending at right angles to the longitudinal axis of the track. In use, the Mitchell aparatus engages the sides of the soles of the shoe, permitting the sole of the shoe to contact the exposed face of the track. The springs urge the shoe clamping members towards one another securely engaging opposed points on the shoe sole marginal edges. However, the Mitchell apparatus prevents the shoe from engaging the vertical standard to which the track is mounted thereby pitching the toe of the shoe outward from such vertical standard a substantial distance, whilst permitting the heel of the shoe to engage such vertical standard. Furthermore, the clamping action of the biasing springs tends to mark the opposed points on the marginal edges of the sole of a shoe so clamped, when such shoe is maintained in a storage position for extended periods of time. The Mitchell apparatus is expensive to construct, limiting the ability of the user to mount up shoes in a wide variety of locations on the vertical standard, excepting in the locations designated along the longitudinal axis of the track member thereof.

SUMMARY OF THE INVENTION

A primary object of the present invention is to provide a shoe mounting apparatus which may be easily and conveniently installed to a vertical standard.

Another object of the present invention is to provide a shoe mounting device which is inexpensive to manufacture, durable in construction, and totally effective for its intended purpose.

Still another object of the present invention is to provide a shoe mounting device which has no moving parts.

Yet another object of the present invention is to provide a shoe mounting apparatus which grasps only opposed points on the marginal edges of the sole of the shoe.

A further object of the present invention is to provide a shoe mounting device permitting the sole and heel of the shoe to be substantially in contact with the vertical standard supporting such shoe mounting device.

Another object of the present invention is to provide a shoe mounting device which utilizes the forces of gravity to support the shoe therein, without requiring adjustments of any type for securing the shoe to the device.

Still another object of the present invention is to provide a shoe mounting device which can be modified so as to be adjusted to accomodate shoes of varying width, if desired.

Yet another object of the present invention is to provide a shoe mounting device which does not engage the vamp of the shoe, thereby eliminating scuffing.

A further object of the present invention is to provide a shoe mounting device of minimal weight, thereby permitting such device to be mounted to the interior surface of closet doors and the like.

Heretofore, shoe mounting devices ranged from the extremely complex, difficult to manufacture, and awkward to use variety, to the type of device which was suitable for mounting to vertical surfaces having sufficient width to accomodate same and tending to scuff up or mark the outermost surface of the shoe. With the advent of shoes having sole thicknesses ranging from the very thin to the very thick, including heels whose thickness also widely vary from shoe style to shoe style, shoe mounting devices which are currently available are inadequate. Furthermore, since shoes are generally stored in darkened and awkward to reach areas, it is highly desirable to make the device simple to use and totally flexible as to the location of the installation thereof. In some installations, it is desirable to place no more than a pair of shoes, or perhaps even a single shoe, along one horizontal line. In other locations, it is desirable to store a plurality of shoes, extending along an indefinite length of horizontal line.

The present invention provides a device which is totally in accord with these needs and does so by providing an apparatus which is inexpensive to manufacture yet totally durable in construction. Such device, by relying on gravity alone, eliminates moving parts, complex maneuvering of the shoe to fit same into or from the storage position thereon, whilst providing an apparatus that may be easily secured to the vertical standard or wall to which it is to be mounted. Furthermore, by allowing the shoe to rest only on a portion of a thin strap-like apparatus, the shoe is substantially entirely in contact with the wall, thereby occupying a minimum of space. A minor modification of the basic apparatus permits it to be utilized in grasping a spectrum of shoes of variable width, ranging from child sizes up to the largest size which can be employed by men. Since a simple stamping and forming operation is required, when the apparatus is fabricated from metal, the present invention can be produced most economically. Alternatively, the present invention lends itself to construction from plastic materials, of common variety.

DESCRIPTION OF THE PREFERRED EMBODIMENT

Figure 1:
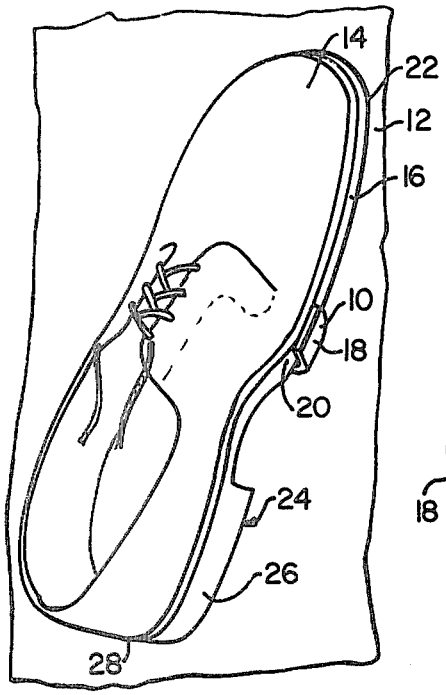
FIG. 1 is a perspective view of a left shoe, shown mounted on a vertical standard, clamped within the left handed version of the present invention.

The structure and method of fabrication of the present invention is applicable to a pair of elongated straps, preferably fabricated from a metallic material, such as stainless steel. If desired, the apparatus can be fabricated from a plastic material, such as polypropylene or polyamide. In either alternative, the present invention utilizes two such straps, one having the function of grasping a left handed shoe whilst the other grasping a right handed shoe, both by engaging the marginal edges of the sole of the shoe intermediate the instep and the toe of the shoe. Each strap is provided with two hook-like ends. One hook-like end is substantially a surface of revolution whose axis of generation extends transverse to the longitudinal axis of the elongated strap but displaced outwardly from and parallel to the interior lateral surface of such strap. The other hook-like end comprises a portion of the surface of a truncated conical surface whose longitudinal axis extends transverse to the longitudinal axis of the strap and parallel to the axis of generation defining the other hook-like end. One strap is defined being the mirror image of the other, such that the surface defining the interior of the hook-like ends, being contiguous with each other and one lateral surface of the strap, has the surface of revolution disposed in the place where the portion of the truncated conical surface is located on the other strap. In this fashion, one of the staps is suitable for engaging the left shoe, whilst the other strap is suitable for engaging the right shoe. The left shoe has the interior aspect of the shoe engaging the surface of revolution whilst the exterior aspect of the shoe engages the surface defined as a portion of the surface of a truncated cone. The other strap, having the hook-like ends reversed, engages the left handed shoe. Each of the straps is provided with a pair of mounting holes, through which screws may pass, securing the straps to a vertical standard. When the straps are aligned so as to have their longitudinal axes extend along a common line, a pair of shoes may be supported therein, having the heel portion of the shoe in a downmost position by permitting the apex end of the portion of the truncated conical surface to be likewise disposed in a downmost direction. The shoes may be secured to the wall, having the left handed shoe on the left side of the right handed shoe, when viewed facing the wall, or if desired, in the opposite sense.

In an alternate embodiment of the present invention, two straps are utilized to form a clamping device for each shoe. One of such straps is provided having the surface of revolution, above defined, whilst the other strap, comprising the pair of straps for clamping one shoe, is provided having the surface defined as a portion of the surface of the truncated cone. Each of the straps is provided having an elongated slot extending along the longitudunal axis of the strap. In use, a pair of bolts pass through both slots, such that the straight portion of each of the straps overlap one another. By adjusting the displacement of the straps, along such common line, the distance separating the surface of revolution and the hook-like end defined as being a portion of a surface of a truncated cone may be separated any desired distance. Then, by tightening the screws, the mechanism is left in the adjusted position, tightened against the vertical standard, capable of accepting shoes of any predetermined width.

Obviously, in either embodiment, the hook-like end, defined as being the surface of revolution, may have the corners thereof, adjacent the hook-like end rounded to secure against marring the perimeter of the sole that such end engages. In exactly the same fashion, the other hook-like end, defined as being a portion of the surface of a truncated cone, may have its corners rounded in like fashion. The curvature of the hook-like end, at each end of the straps having two hook-like ends, and of the embodiment which is adjustable, may be defined gradually so as to accomodate shoes whose soles are thicker than soles of conventional width.

Now referring to the figures, and more particularly to the embodiment illustrated in FIG. 1 showing the left handed version of the present invention 10 secured to a vertical surface 12. Shoe 14 is shown engaged within shoe mounting apparatus 10 by having sole perimeter 16 engaged within hook-like end 18, adjacent point 20 thereof. The other end, now shown, of shoe mounting apparatus 10, engages sole 16. It should be noted that surface 22, of sole 16 as well as surface 24, of heel 26, engages surface 12 whilst shoe 14 is clamped within shoe mounting apparatus 10. Heel portion 28 is shown in a lowermost position, utilizing the force of gravity to maintain shoe 14 within shoe mounting apparatus 10.

Figure 2:
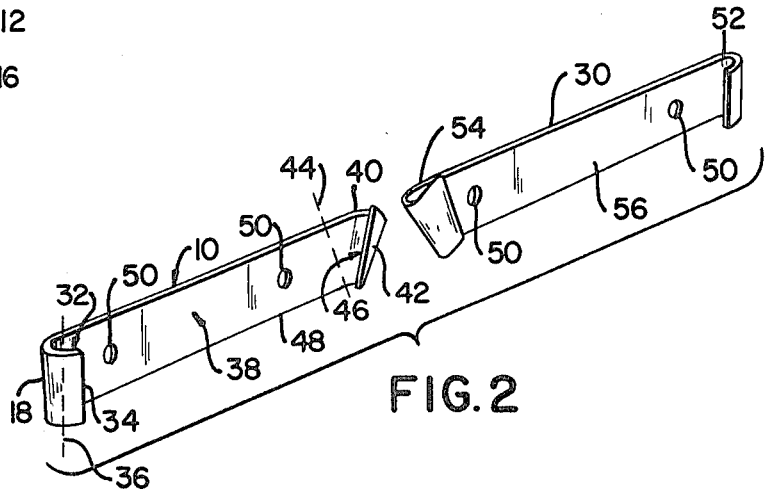
FIG. 2 illustrates a perspective view of a left handed and a right handed embodiment of the present invention.

FIG. 2 illustrates shoe mounting apparatuses 10 and 30. Hook-like end 18 is shown having a surface of revolution 32 adjacent end 34, of strap 10. Such surface of revolution extends radially outwardly from dotted lines 36. Dotted lines 36 are disposed outwardly from lateral surface 38. Interior surface 32 is shown contiguous with surface 38. Hook-like end 40 is shown adjacent end 42, of shoe mounting apparatus 10, shown in strap form. Dotted lines 44 define the center of an imaginary cone. Such cone, not shown, defines the interior surface 46 of hook-like end 40. Thus, interior surface 46 may be defined as a portion of the surface of a truncated conical surface. It should be noted that the interior 46 is contiguous with surface 38 and both interior surfaces 32 and 46 are disposed on one side of straight portion 48 of shoe mounting apparatus 10. Holes 50 pass through shoe mounting apparatus 10.

Shoe mounting apparatus 30, shown in strap form, is also provided with holes 50, as well as hook-like end 52 being similar in shape to hook-like end 18. Hook-like end 54, located at the opposite end of strap shoe mounting apparatus 30, is similar to hook-like end 40. Surface 56 is shown intermediate hook-like ends 52 and 54. It should be noted that strap 30 and strap 10 are identical, accepting for the fact that hook-likes ends 54 and 52 are opposite to hook-like ends 40 and 18. The distance separating hook-like ends 18 and 40 is equivalent to the distance separating hook-like ends 52 and 54.

Figure 3:
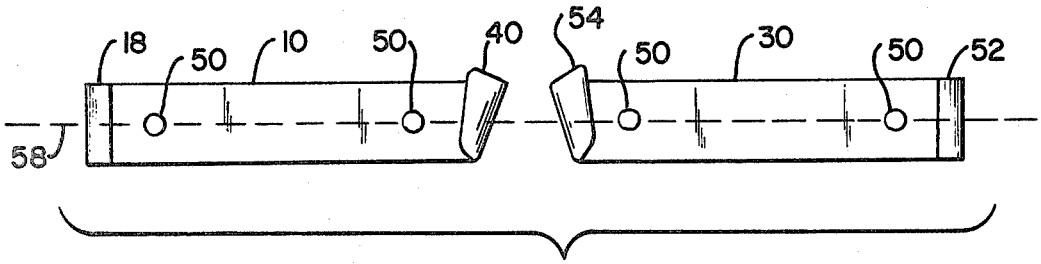
FIG. 3 illustrates a front elevation view of the apparatuses shown in FIG. 2.

FIG. 3 illustrates show mounting apparatus strap 10 and 30, being disposed in side by side relationship, extending along a common line, shown by dotted lines 58. Holes 50 are shown aligned on dotted line 58. Thus, in use, a user simply scribes a line, in a horizontal direction, and installs holes 50, along such line, so as to position straps 10 and 30 properly for the retention of shoes, not shown, therein.

Figure 4:
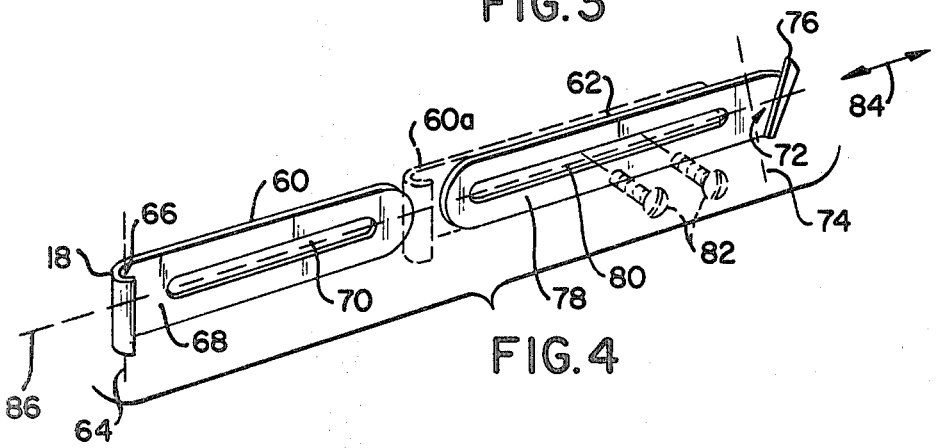
FIG. 4 illustrates an alternate embodiment of a left handed version of a shoe grasping device.

FIG. 4 illustrates the alternate embodiment of the invention shown in FIGS. 1, 2 and 3, depicted therein as shoe mounting apparatus 10. In such embodiment, strap 16 is shown provided having hook-like end 18, defined as a surface of revolution centered about dotted lines 64 having an interior surface 66 contiguous with lateral surface 68. Elongated slot 70, extends in lateral surface 68. Strap 62 is provided having an interior surface 72 defined as being a portion of the surface of a truncated conical surface whose longitudinal axis extends along dotted lines 74, defining hook-like end 76 thereby. Lateral surface 78 defines the location of elongated slot 80. Screws 82 may be utilized to pass through slot 80, engaging slot 70, when lateral surface 68 is engaged with the lateral surface opposite to lateral surface 78. In such position, strap-like element 60 is disposed in the position shown by dotted lines 68. Strap elements 60 and 62 may be moved relative to one another, along arrows 84, permitting hook-like ends 18 and 76 to be disposed an adjustable distance from one another thereby. Tightening screws 80, into a vertical standard not shown, maintains straps 60 and 62 at any preferred relative location whereby their longitudinal axes are positioned along dotted lines 86.

One of the advantages of the present invention is to provide a shoe mounting apparatus which may be easily and conveniently installed to a vertical standard.

Another advantage of the present invention is to provide a shoe mounting device which is inexpensive to manufacture, durable in construction, and totally effective for its intended purpose.

Still another advantage of the present invention is to provide a shoe mounting device which has no moving parts.

Yet another advantage of the present invention is to provide a shoe mounting apparatus which grasps only opposed points on the marginal edges of the sole of the shoe.

A further object of the present invention is to provide a shoe mounting device permitting the sole and heel of the shoe to be substantially in contact with the vertical standard supporting such shoe mounting device.

Another advantage of the present invention is to provide a shoe mounting device which utilizes the forces of gravity to support the shoe therein, without requiring adjustments of any type for securing the shoe to the device.

Still another advantage of the present invention is to provide a shoe mounting device which can be modified so as to be adjusted to accommodate shoes of varying width, if desired.

Yet another advantage of the present invention is to provide a shoe mounting device which does not engage the vamp of the shoe, thereby eliminating scuffing.

A further advantage of the present invention is to provide a shoe mounting device of minimal weight, thereby permitting such device to be mounted to the interior surface of closet doors and the like.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A shoe mounting apparatus comprising a pair of straps, each of said pair of straps having a first hook-like end and a second hook-like end thereon, said first hook-like end having a surface being a portion of a surface of revolution, said surface of revolution defined by an axis of revolution, said axis of revolution extending transverse to the longitudinal axis above said strap and outwardly from a first lateral surface thereof, said second hook-like end having a surface area being a portion of the surface area of a truncated conical surface, said truncated conical surface having a longitudinal axis transverse to said longitudinal axis of said strap and extending outwardly from said lateral surface thereof, said each of said pair of straps defining a first edge and a second edge extending at said second hook-like end, said first edge defining a larger partial open mouth portion than the partial open mouth portion defined by said second edge, said each of said pair of straps defining a third edge and a fourth edge extending at said first hook-like end, said third and said fourth edge defining a pair of partial open mouth portions each having the same size, wherein said larger open mouth portion is larger than each of said pair of partial open mouth portions, means to secure said pair of straps to a vertical standard.

2. The apparatus as claimed in claim 1 wherein said means to secure comprises at least one opening passing through said lateral surface.

3. The apparatus as claimed in claim 1 wherein said pair of straps comprise a metallic material.

4. The apparatus as claimed in claim 3 wherein said metallic material comprises stainless steel.

5. The apparatus as claimed in claim 1 further comprising means to adjustably position said first hook-like end and said second hook-like end a selected distance apart including means to lockingly secure said first hook-like end and said second hook-like end at said selected distance.

6. The apparatus as claimed in claim 5 wherein said means to adjustably secure comprises bifurcating each of said pair of straps into a flat portion and a hook-like end portion, said flat portion carrying a elongated slot disposed extending along said longitudinal axis of said strap, a pair of screws, said pair of screws being disposed passing through said elongated slots when one of said bifurcated straps has said straight portions thereof disposed in overlying relationship with said straight portion of said other bifurcated straps and when said slots disposed in said straight portions are at least partially juxtaposed.

7. The apparatus as claimed in claim 1 wherein said pair of straps are from a plastic material.

8. The apparatus as claimed in claim 7 wherein said plastic material comprises polyamide.

9. The apparatus as claimed in claim 1 wherein said first hook-like end and said second hook-like end has said interior surfaces thereof contiguous with one another and with said lateral surface for one of said pair of straps and wherein said interior surface of said first hook-like end and said second hook-like end are contiguous with one another and with the other lateral surface for said other of said pair of straps.

* * * * *